US006131349A

United States Patent [19]

Hill

[11] Patent Number: 6,131,349

[45] **Date of Patent: *Oct. 17, 2000**

[54] INTEGRATED COMMUNICATIONS EQUIPMENT ENCLOSURE AND ANTENNA TOWER

[75] Inventor: Douglas L. Hill, Odessa, Tex.

[73] Assignee: Monosite, Inc., Odessa, Tex.

[ * ] Notice: This patent is subject to a terminal disclaimer.

[21] Appl. No.: 09/332,584

[22] Filed: Jun. 14, 1999

Related U.S. Application Data

[60] Continuation of application No. 09/167,010, Oct. 6, 1998, Pat. No. 5,941,036, which is a division of application No. 08/807,078, Feb. 25, 1997, Pat. No. 5,904,004.

[51] Int. Cl.[7] ..... E02D 27/02

[52] U.S. Cl. ..... 52/292; 52/79.1; 343/890

[58] Field of Search ..... 52/292, 299, 79.1, 52/40, 27; 343/720, 890

[56] References Cited

U.S. PATENT DOCUMENTS

| | | |
|---|---|---|
| 1,426,276 | 8/1922 | Christie . |
| 1,664,161 | 3/1928 | Considine . |
| 1,924,033 | 8/1933 | Flor . |
| 2,933,165 | 4/1960 | Rose . |
| 3,094,303 | 6/1963 | Belger . |
| 4,069,626 | 1/1978 | Schuette . |
| 4,649,675 | 3/1987 | Moldovan et al. . |
| 4,951,433 | 8/1990 | Miller et al. . |
| 5,162,807 | 11/1992 | Ursenbach et al. . |

FOREIGN PATENT DOCUMENTS

| | | |
|---|---|---|
| 813 074 | 9/1951 | Germany . |
| 2076036 | 11/1981 | United Kingdom . |

*Primary Examiner*—Michael Safavi
*Attorney, Agent, or Firm*—Akin, Gump, Strauss, Hauer & Feld, L.L.P.

[57] ABSTRACT

An integrated enclosure and antenna support tower for telecommunications equipment, such as cellular telephone, radio transmitter/receivers. The enclosure includes a generally rectangular tubular steel frame including vertical column members, roof purlins and roof rafters welded together to form a frame for supporting exterior wall paneling and roof decking. A cylindrical cross-section metal plate tower section is supported on the enclosure frame by a plurality of webs interconnecting the tower section with the frame to transfer the weight of the tower to the frame column members. Conventional antennas or antenna truss type towers may be mounted on the tower section connected to the enclosure. The tower section may serve as a duct for enclosure ventilation air for intake or exhaust of such air at an elevation substantially above ground level. An air intake or exhaust plenum may also be mounted directly adjacent to or formed as part of the enclosure. The integrated enclosure may include a support base, a climate control enclosure building and an antenna tower support member disposed on the support base directly adjacent the enclosure building.

9 Claims, 7 Drawing Sheets

INTEGRATED COMMUNICATIONS EQUIPMENT ENCLOSURE AND ANTENNA TOWER

This application is a continuation of patent application Ser. No. 09/167,010, filed Oct. 6, 1998 now U.S. Pat. No. 5,941,036 issued Aug. 24, 1999 which is a division of patent application Ser. No. 08/807,078 filed Feb. 25, 1997, now U.S. Pat. No. 5,904,004.

FIELD OF THE INVENTION

The present invention pertains to an integrated telecommunications equipment enclosure and antenna tower, particularly adapted for wireless telephone transmission and receiver equipment and the like.

BACKGROUND OF THE INVENTION

The continued development of remote sites for telecommunications equipment, or other self-contained sites for such equipment, has brought on the necessity of providing relatively small enclosures for housing radio equipment, power converters and backup generators for powering the radio transmission and receiver units. Telecommunications equipment enclosures, particularly of the type used for so-called cellular telephone systems, are typically relatively small buildings which are somewhat self-contained in the sense that they may include their own electrical power supplies or power conversion equipment for the radio communications units within the enclosure and air-conditioning equipment used to maintain a predetermined range of environmental conditions within the enclosure. Typically a relatively tall antenna support tower is associated with the enclosure and is normally supported on a separate support structure.

In fact, heretofore, communications equipment enclosures located at remote sites or "rural" sites, for example, have been supported on conventional foundations such as reinforced concrete slabs or pads. The concentrated weight of the antenna tower has, in prior art-type installations, required a relatively substantial and separate foundation member such as a deep reinforced concrete pier. The installation of communications equipment enclosures at remote sites has made it particularly difficult to provide equipment for drilling a hole of sufficient depth to support a separate reinforced concrete pier of sufficient strength to serve as a foundation for the antenna and its supporting tower.

Moreover, in many wireless telephone equipment enclosures and similar communications equipment installations, the enclosure itself may require to be mounted on the roof of a building or other structure. Accordingly, the separate installation of a tower for the communications antennas also presents problems with regard to providing sufficient space and support structure for such a member. Still further, the provision of separate enclosures and antenna support tower installations also requires a cable conduit "bridge" between the antenna tower and the enclosure which increases the chances for signal degradation that may be created by training the transmission cables over a somewhat complex route between the antenna and the enclosure.

Accordingly, there has been a substantial need to provide improvements in communications equipment enclosures which will eliminate some of the problems of installing these enclosures efficiently and rapidly which has been dictated by the rapid growth in wireless communications systems throughout the world. It is to solving the above-mentioned problems that the present invention is directed.

SUMMARY OF THE INVENTION

The present invention provides an improvement enclosure for telecommunications equipment including a support tower for an antenna integrated with the enclosure. The integrated antenna support tower and communications equipment enclosure of the present invention reduces the space required for the enclosure, eliminates the need for constructing a separate foundation or other support structure for the antenna tower and advantageously utilizes the support structure or frame for the equipment enclosure to support the weight of the antenna and associated tower.

In accordance with one important aspect of the invention, an integrated communications equipment enclosure and antenna support tower is provided by a building having a metal framework including a plurality of support columns and a tower member or section which is interconnected to the framework to transfer the weight of the tower and any antenna supported thereby through the framework, including the columns, to a support structure for the enclosure. In particular, the tower includes a base section which may be formed of a monocoque structure, such as a cylindrical shaped metal plate or duct member.

In accordance with another important aspect of the invention, a communications equipment enclosure and a support base therefore may be fabricated as an integrated or self-contained structure and include a portion of the base for supporting a communications antenna tower. By providing a common base member for the enclosure and the tower, the entire installation may be prefabricated and shipped to the installation site thereby minimizing the construction of separate foundation or support structures at the site for both of the enclosure and the antenna tower.

In accordance with still another important aspect of the invention, a telecommunications equipment enclosure is provided which includes ventilation air intake and exhaust structure which is particularly adapted for minimizing the ingestion of precipitation, including deep snow surrounding the enclosure, or airborne dust at low elevations or ground level, for example. The enclosure includes an intake air plenum or passageway which is defined by at least part of the integral antenna tower. Accordingly, the integrated antenna tower and enclosure also includes means for admitting or exhausting ventilation air for the enclosure.

The integrated enclosure and antenna support tower may be advantageously prefabricated substantially in its entirety and shipped to an installation site whereby a minimum amount of site preparation is required in many instances and in substantially all instances, only a single enclosure support or foundation is required to be prepared at the site.

Those skilled in the art will appreciate the above-mentioned advantages and superior features of the invention together with other important aspects thereof upon reading the detailed description which follows in conjunction with the drawing.

DESCRIPTION OF THE PREFERRED EMBODIMENTS

Figures 1, 1A:
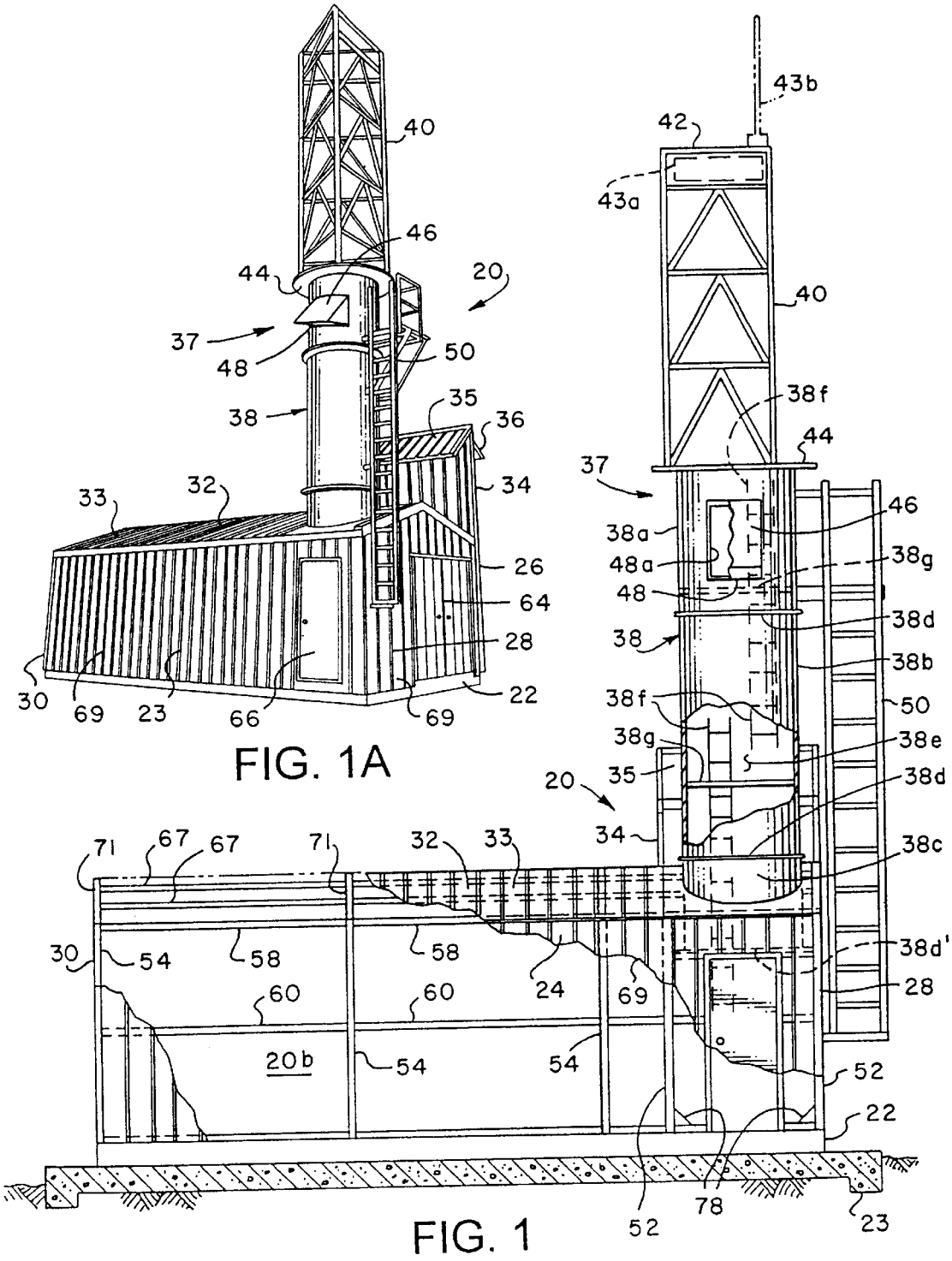
FIG. 1 is a side elevation of one embodiment of an integrated enclosure and antenna support tower in accordance with the invention.
FIG. 1A is a perspective view of the enclosure shown in FIG. 1.

In the description which follows, like parts are marked throughout the specification and drawings with the same reference numerals, respectively. The drawing figures are not necessarily to scale and certain features may be shown in somewhat schematic or generalized form in the interest of clarity and conciseness.

Figure 2:
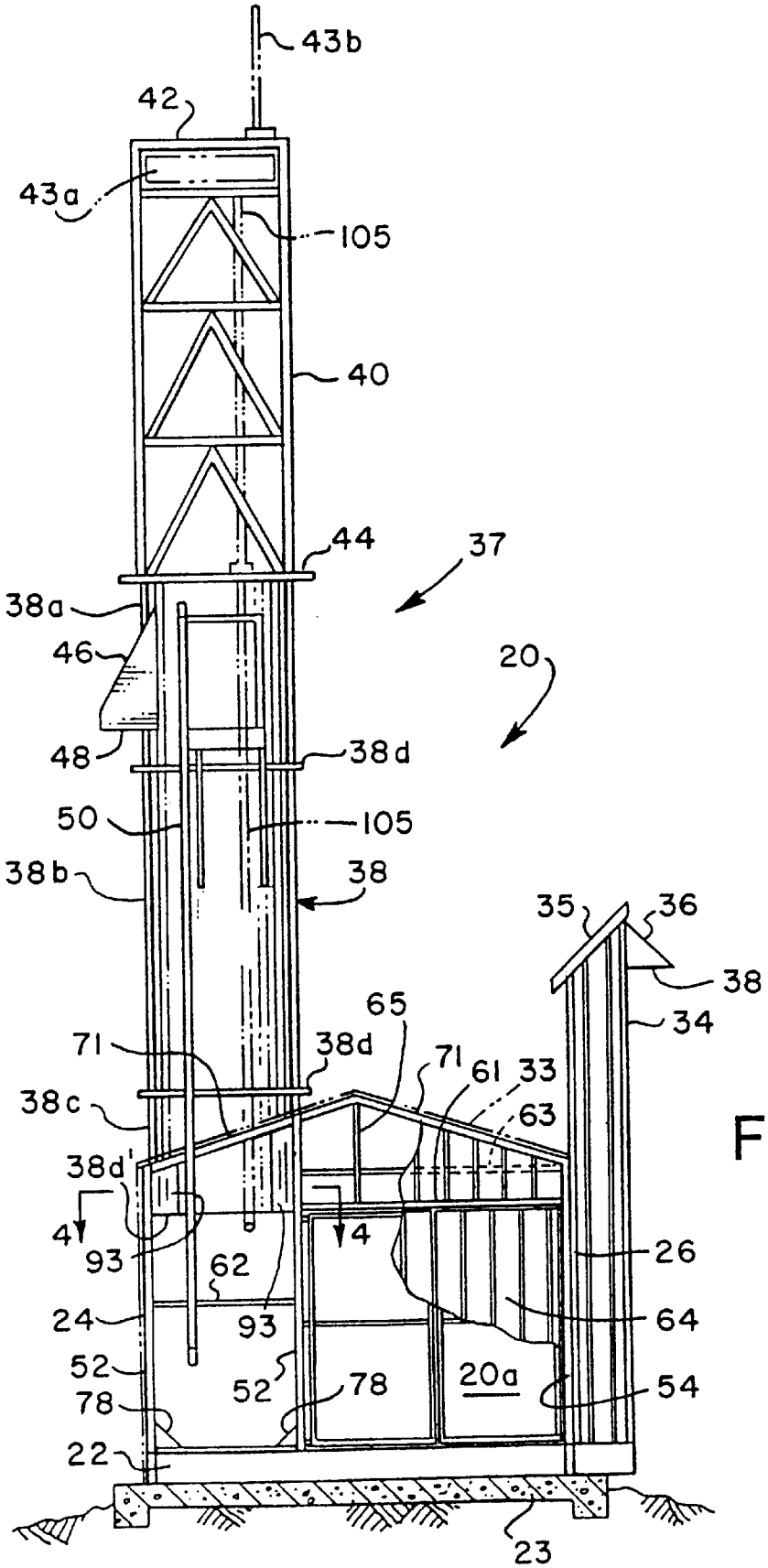
FIG. 2 is an end view of the enclosure shown in FIG. 1.

Referring to FIGS. 1, 1A and 2, in particular, one embodiment of an integrated enclosure and antenna support tower in accordance with the invention is shown and generally designated by the numeral 20. The enclosure 20 is adapted to include a support base 22 which is operable to rest on and be suitably secured to a conventional reinforced concrete foundation 23, for example. However, the enclosure 20, including the support base 22, may also be supported on other types of substructure. For a typical remote installation of the enclosure 20, a generally rectangular, poured, reinforced concrete foundation, such as the foundation 23 is typically provided. The enclosure 20 is characterized also as a generally rectangular metal framed building having opposed sidewalls 24 and 26, opposed endwalls 28 and 30 and a pitched roof 32. A generally rectangular ventilation air plenum 34 is mounted adjacent to and connected to the sidewall 26 and projects above the roof 32, as shown in FIG. 2. The plenum 34 includes a shed roof portion 35 and a ventilation air exhaust hood 36 having a downward facing ventilation air exhaust opening 38, FIG. 2.

Referring further to FIGS. 1, 1A and 2, the enclosure 20 includes an integral antenna support tower 37 including a lower tower section 38 and a truss-type upper tower section 40 for supporting suitable communications antenna at an upper distal end 42, such antenna being shown in FIGS. 1 and 2 and indicated by numerals 43*a* and 43*b*, for example. Those skilled in the art will appreciate that any antenna support-able on the tower 37 may be placed thereon, as desired, for use with a particular type of communications equipment. The tower section 38 preferably comprises one or more monocoque members, such as generally cylindrical duct members 38*a*, 38*b* and 38*c* formed of relatively thin-walled metal plate or the like and suitably interconnected at transverse flanges 38*d*. The tower section 38 may also be a single member. A transverse flange 44 is disposed at the upper end of the tower section 38 for supporting the truss-type tower section 40 thereon. A ventilation air intake hood 46 is supported on the tower section 38*a* and includes a ventilation air inlet opening 48 formed therein and facing generally downwardly toward the roof 32. Ventilation air flows between hood 46 and tower section 38 through a port 48*a*, FIG. 1, formed in member 38*a*. A suitable access ladder 50 is connected to the tower section 38 and depends therefrom to a predetermined point adjacent the endwall 28 to provide access to the tower 37 and any antenna disposed thereon.

Figure 3:
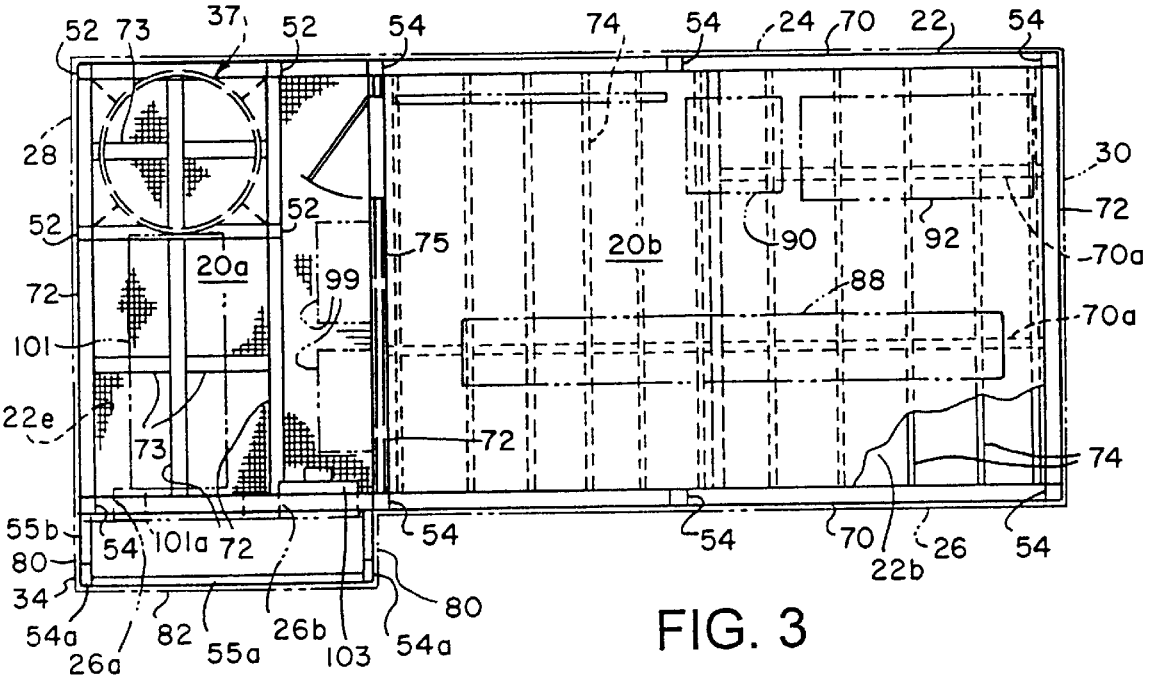
FIG. 3 is a plan view showing certain details of a support base and framing for the enclosure shown in FIGS. 1 and 2.
Figure 4:
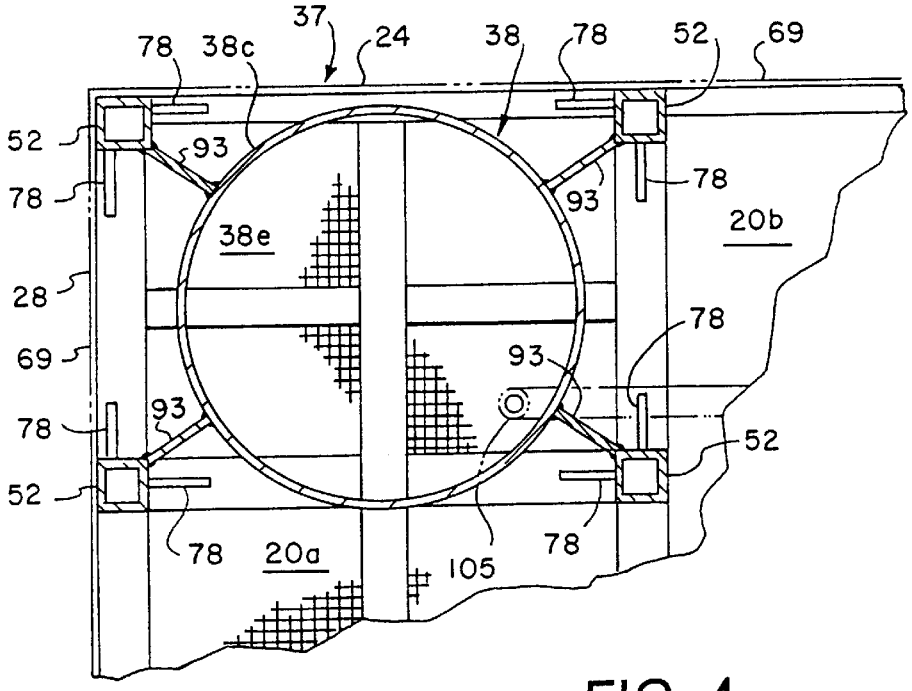
FIG. 4 is a detail section view taken along the line 4—4 of FIG. 2.
Figure 5:
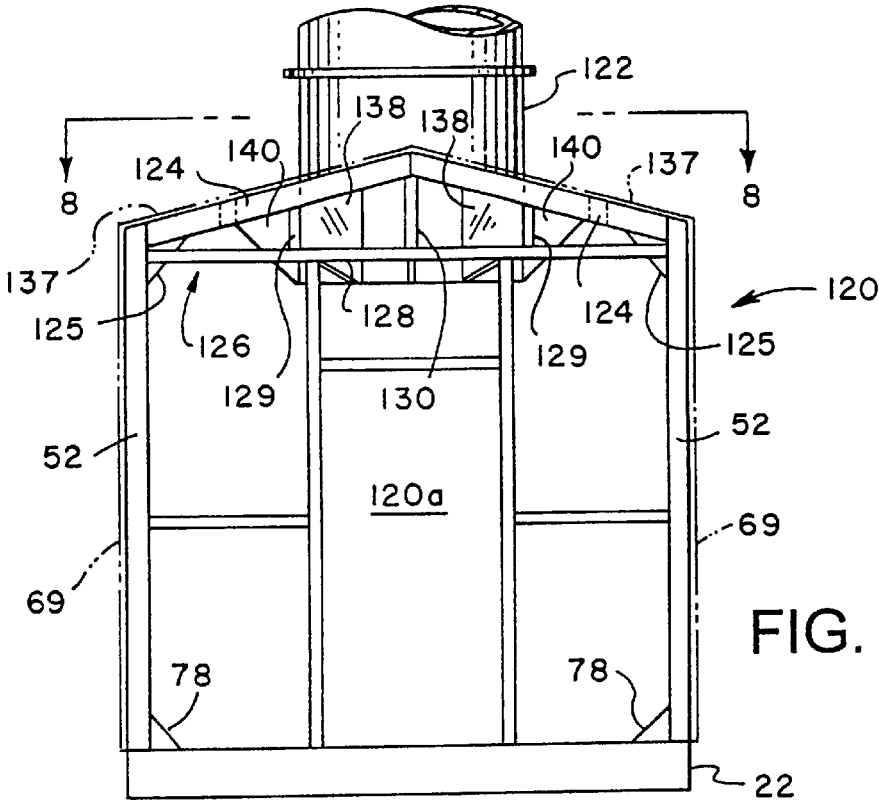
FIG. 5 is an end view of an enclosure frame in accordance with a first alternate embodiment of the present invention.
Figure 6:
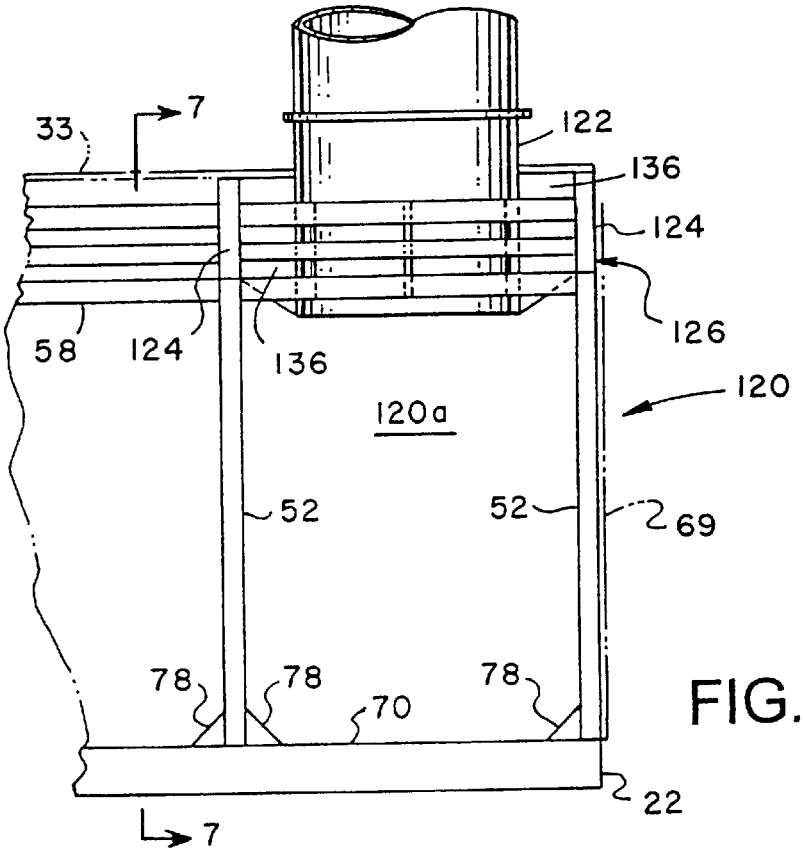
FIG. 6 is a detail side elevation of the frame of the embodiment shown in FIG. 5.
Figure 7:
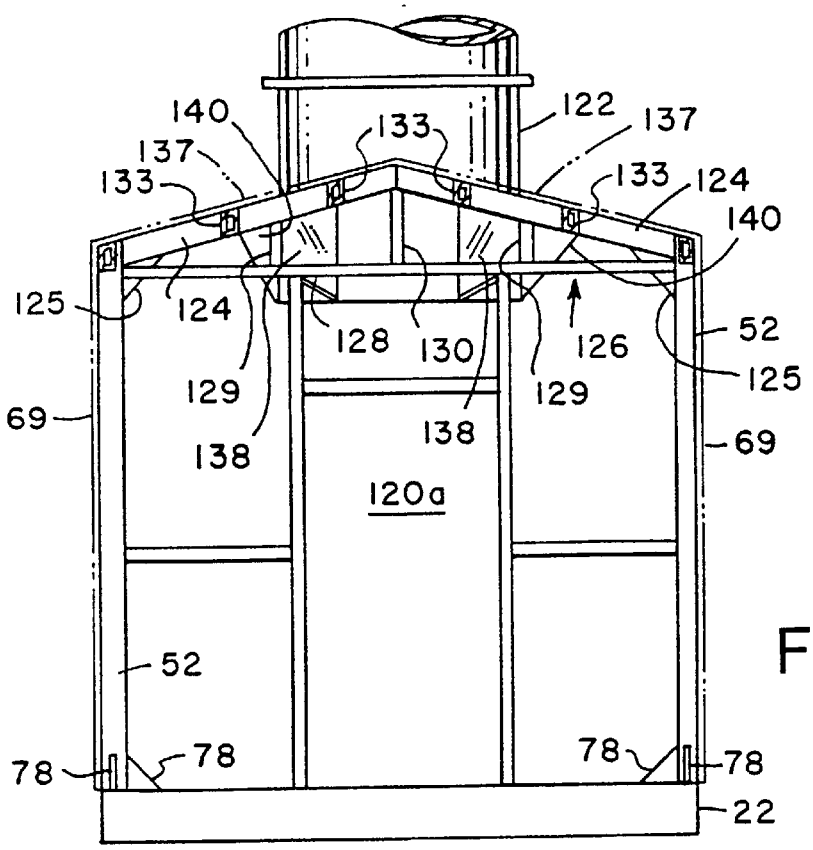
FIG. 7 is a section view taken along the line 7—7 of FIG. 6.

Referring further to FIGS. 1 through 4, the enclosure 20 includes a metal frame comprising four spaced-apart vertical column members 52 arranged in a generally rectangular pattern directly below the tower 37, FIG. 4. One of the column members 52 serves as a corner column of the intersecting sidewall 24 and endwall 28. Two other of the column members 52 are disposed in the planes of the respective sidewall 24 and endwall 28. Additional column members 54 are spaced-apart along the sidewalls 24 and 26 and at the intersections of the sidewalls with the endwalls 28 and 30 to form a further portion of the enclosure frame. Horizontal beam members or girts 58 and 60 interconnect the column members 52 and 54 forming the sidewalls 24 and 26, as shown by example in FIG. 1, and transverse beam members 61 and 62 extend between the column members 52 and between the column members 52 and 54, as shown in FIG. 2, for example. The endwall 28 of the enclosure 20 may have a double, hinged door 64 formed therein and the sidewall 24 may also have a single hinged access door 66 formed therein.

The pitched roof 32 may be made up of truss structure including opposed rafter members 71 connected to each other at the roof peak or ridge and to the column members 52 and 54, respectively. The rafters 71 are also interconnected by a transverse beam member or members 63 extending between columns 52 and 54 at each truss. Accordingly, each truss is preferably made up of two rafters 71, a transverse beam member 63 and a vertical leg or column 65, see FIG. 2. Opposed parallel sets of purlins 67 extend between adjacent rafters 71, as shown by example in FIG. 1.

The sidewalls 24 and 26 and the endwalls 28 and 30 may include suitable exterior wall structure including, for example, corrugated metal sheeting 69 which is suitably secured to the frame described above in a conventional manner. Interior insulation may also be secured to the sheeting 69 to provide suitable weather-proofing for the enclosure 20. Other types of wall panelling may be used in place of that just described. In like manner, the roof 32 is also provided with suitable decking comprising corrugated metal sheeting 33, the interior facing side of which may have secured thereto suitable insulation material, not shown.

Referring to FIG. 3, the support base 22 is preferably characterized by a ladder-type frame or skid, including spaced-apart outer longitudinal beams 70, intermediate longitudinal beams 70*a* and transverse end beams 72. A plurality of spaced-apart floor joists or transverse beams 74 overlie the beams 70*a*, extend parallel to the beams 72 and are connected at their opposite ends to the longitudinal beams 70. As further shown in FIG. 3, the end of the support base 22, directly under the tower 37, is reinforced with two additional intermediate transverse beams 72 and cross members or beams 73 disposed between the spaced apart beams 72, as illustrated. A fourth transverse beam 72 is spaced from the two intermediate beams 72, just described and forms a support for an interior wall 75 extending between the sidewalls 24 and 26 and substantially parallel to the end walls 28 and 30. The support base 22 may include suitable flooring or decking 22*d*, at least a portion of which may be metal grating 22*e*, FIG. 3. The ladder-type frame or support base 22 may be constructed in a conventional manner by welding the aforementioned beams and joists to each other at their contiguous points. Alternatively, the support base 22 may be assembled by bolting the aforementioned structural members together.

The column members 52 and 54 are supported on the beams 70 and 72 and are suitably secured thereto, such as by welding or by conventional mechanical fasteners. The column members 52, in particular, are further secured to the beams 70 and 72 by triangular gussets, 78, FIGS. 1, 2 and 4, which are suitably welded to the beams 70 and 72 and to the columns 52.

Referring further to FIG. 3, the plenum 34 is also constructed of spaced-apart vertically extending column members 54*a* suitably interconnected by girts 55*a* and 55*b*. The plenum 34 is also formed by suitable metal sheeting or panels 80 and 82 forming the sidewalls of the plenum and suitable decking forming the shed roof 35 of the plenum. A section of the sidewall 26 adjacent to and contiguous with the plenum 34 is provided with openings 26*a* and 26*b* for conducting ventilation air between an interior room or space 20*a* of the enclosure 20 and the plenum 34 for discharge from the plenum by way of the opening 38, for example. As shown in FIG. 3 also, the particular embodiment of the enclosure 20 illustrated has two interior rooms or spaces 20*a* and 20*b* which are provided by the interior wall or partition 75 extending between the sidewalls 24 and 26 and to the roof 32. The interior room 20*b*, for example, may be climate-controlled to provide suitable environmental protection for equipment such as, for example, radio frequency communications transmitter/receivers 88, power converters 90, and batteries 92, for example.

Referring now to FIGS. 1, 2 and 4, in particular, the tower section 38 extends through the roof 32 to a lower-end 38*d*' within the room 20*a* and is supported on the columns 52 by spaced-apart radially extending webs 93, four shown in FIG. 4, which are connected to the exterior surface of the tower section 38*c* by suitable welds, for example, and also to the columns 52 by suitable welds. Other means of attaching the webs 93 to the cylindrical tower section 38*c* and to the columns 52 may be provided. In the arrangement of the enclosure 20, the tower 37 is offset with respect to the longitudinal centerline of the enclosure, as shown, for reasons of placement of certain equipment within the interior room 20*a*. As will be appreciated by those skilled in the art, the location of the tower 37 may be along the centerline of the enclosure or in other offset positions. However, the tower 37 is integral with the enclosure and is supported by column members of the enclosure which also comprise column members of the enclosure frame. The tower section 38 is suitably sealed to the enclosure at the point of intersection with the roof 32, such as by welding the tower section to the roof decking 33, for example.

Another advantage of the enclosure 20, illustrated in conjunction with FIGS. 1 through 4, is that the tower section 38 also serves as a ventilation air duct for conducting ventilation air into or from the enclosure, as desired. Referring again to FIGS. 1 through 4, the tower section 38 opens into the interior space 20*a* wherein one or more air conditioning units 99, FIG. 3, are supported on the interior wall for discharging conditioned air into the room 20*b* and for rejecting heat to or absorbing heat from air within the space 20*a*, as needed. The air conditioning units 99 may be conventional reversible vapor compression heat pump-type units, for example, or a combination of heat pump and electrical resistance heating equipment, for example.

The interior space 20*a* may also contain an internal combustion engine driven electrical generator unit 101, FIG. 3, for supplying power to the communications equipment disposed within the enclosure 20. The self-contained internal combustion engine driven generator unit 101 is shown disposed in space 20*a* and includes an engine coolant radiator or heat exchanger 101*a* disposed directly adjacent the opening 26*a* whereby forced air flow through the heat exchanger 101*a* into the plenum 34 may be provided. Moreover, one or more motor driven fans 103 may be mounted directly adjacent one or more of the opening 26*b* for circulating air into or out of the interior space 20*a*, as needed. Typically, for example, ventilating air may be circulated through the interior space 20*a* by operating the motor driven fan 103 to draw air into the interior room through the hood 46, the duct formed by the tower section 38, through the space 20*a* and the fan 103 and into the plenum 34 for discharge through the hood 36 and its exhaust opening 38.

A particular advantage of the enclosure 20 is enjoyed when the enclosure is mounted at sites wherein very deep snow is often encountered or at sites where very high concentrations of air-borne dust may be experienced at or near ground level. Accordingly, by utilizing a portion, at least, of the antenna support tower 37 as a ventilating air duct, the inlet or exhaust opening for ventilating air for the enclosure 20 may be elevated above the height of snow accumulation or heavy concentrations of air-borne dust near the ground.

Referring briefly to FIG. 2, another advantage of the integrated enclosure and antenna support tower 20 is realized wherein one or more conduits 105, one shown, for antenna cabling, and the like, may be trained directly through the tower section 38 into the interior of the enclosure 20. The conduit 105 may be at least partially supported by and extend through the flange or cover 44, for example, in weathertight sealed relationship thereto. The cable conduit 105 extends through the interior chamber 38*e* of the tower section 38, which chamber also serves as a duct space for ventilating air as described previously. As shown in FIG. 1, the interior space 38*e* of tower section 38 includes suitable access means for inspection and maintenance, including ladders 38*f* and spaced apart, semicircular landings 38*g*, preferably formed of expanded metal gratings.

Referring now to FIGS. 5 through 8, a modification of the enclosure 20, including the enclosure frame, in particular, is illustrated and generally designated by the numeral 120. The enclosure 120 is substantially similar to the enclosure 20, except that the integral tower for supporting a communications antenna is generally centered along the longitudinal central axis of the enclosure 120 and includes a generally cylindrical plate-type or monocoque lower tower section 122. Only the lower tower section is shown in FIGS. 5 through 8, however, those skilled in the art will recognize that the antenna tower for the enclosure 120 may be otherwise constructed like the tower 37. The tower section 122 is disposed between spaced-apart sets of roof rafters 124. Each set of rafters 124 forms part of a truss structure 126, including a ceiling joist 128 and intermediate column members 129 and 130, for example, extending between and welded to the rafters 124 and joist 128. The joists 128 extend between opposed column members 52 and are welded thereto, respectively. The rafters 124 are welded to each other at one end and to the column members 52 at their opposite ends, respectively. Gussets 125 reinforce these connections. The rafters 124 are also interconnected by longitudinal purlins 132 and 133. The enclosure 120 is suitably supported on a support base 22 in the same manner as the enclosure 20.

Figure 8A:
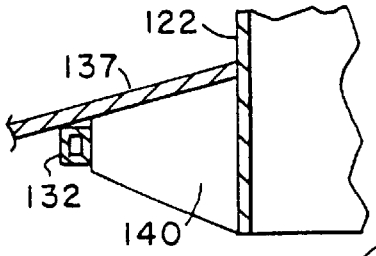
FIG. 8A is a detail section view taken along line 8A—8A of FIG. 8.
Figure 8:
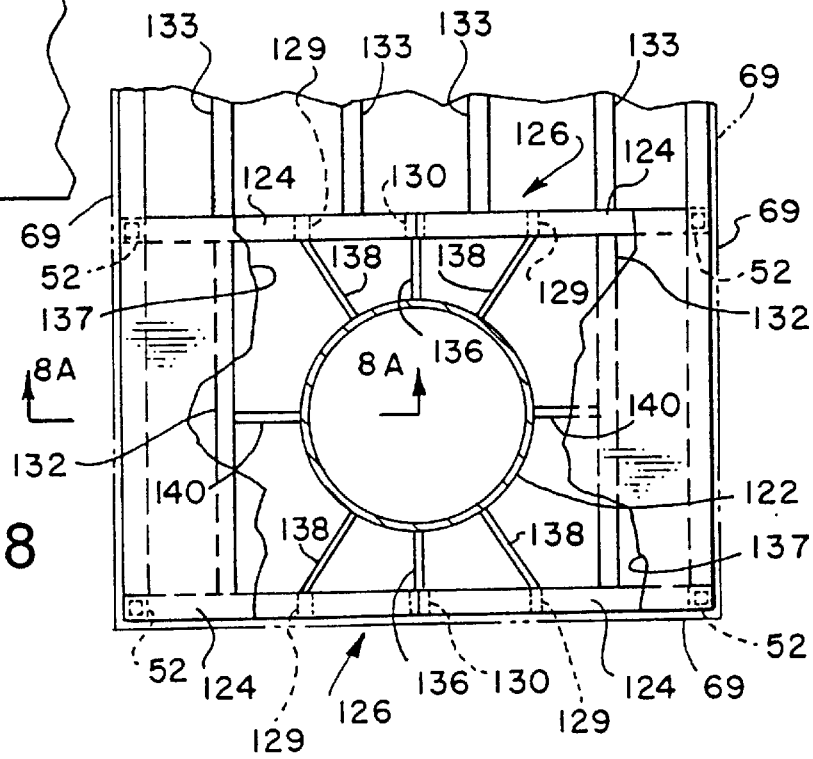
FIG. 8 is a section view taken along the line 8—8 of FIG. 5.

As shown in FIG. 8, in particular, the cylindrical tower section 122 is preferably connected to the frame of the enclosure 120 by a plurality of circumferentially spaced, radially projecting steel plate webs 136, 138 and 140. The webs 136 are preferably connected to the tower section 122 by welding and also by welding to the truss column members 130 along opposed sides of the webs, respectively. In like manner, the webs 138 interconnect the tower section 122 with column members 129 and the webs 140 interconnect the tower section with the purlins 132, respectively. Metal plate roof deck members 137, shown broken away in FIG. 8, are disposed on and secured to the rafters 124 and are preferably welded to the tower section 122, also. The webs 136, 138 and 140 may be welded to the decks 137 also. FIG. 8A is representative of the configuration of the webs and how they are contiguous with the adjacent members, as described herein. FIG. 8A illustrates the configuration of a web 140 showing it contiguous with the tower section 122, purlin 132 and deck plate member 137.

Accordingly, the weight of the tower section 122 and any additional tower structure supported thereon, not shown in FIGS. 5 through 8, is transferred through the webs 136, 138 and 140 and deck members 137 to the enclosure frame, including the above-mentioned truss structures, and the frame columns 52. In this way, an interior space 120*a* of the enclosure 120 is substantially unobstructed by any intermediate column members and the enclosure 120 enjoys the integration of the enclosure with the antenna tower, including the tower section 122, in substantially the same manner as the enclosure 20.

The enclosures 20 and 120 may be constructed using conventional structural metal shapes for the column members, the roof rafters, the girts and ceiling joists and the exterior paneling or sheeting for the sidewalls and roof decking. By way of example, an enclosure 20 or 120 having an overall length of about thirty feet and a width of about thirteen feet may be supported on a support base 22 wherein the longitudinal beams 70 and 70*a* and the transverse beams 72 are formed, respectively, of nominal 12.0 inch, 6.0 inch and 8.0 inch wide flange H or I beam components and the floor joists 74 are formed of 2.0 inch square steel tubing. The beams 70, 70*a* and 72 may also be formed of rectangular or square cross-section tubes. These components are welded together in accordance with conventional steel skid or support base construction practices. The frame for the enclosures 20 and 120 may be constructed using square or rectangular cross-section steel tubing also. In particular, the column members 52 and 54 may be, respectively, formed of nominal 6.0 inch and 4.0 inch square cross-section steel tubing having a nominal 0.10 inch wall thickness. The rafters 71 and 124 may be 6.0 inch square steel tubing and the remaining rafters making up the roofs 32 may be 4.0 inch square steel tubing. Door framing and interior wall column and girt members may be 2.0 inch square steel tubing and the sidewall and endwall girts may be 2.0 inch by 4.0 inch rectangular cross-section steel tubing. The roof purlins may also be 2.0 inch by 4.0 inch rectangular cross-section steel tubing. The webs for connecting the cylindrical tower sections to the enclosure framing may be formed of 0.38 to 0.50 inch thick steel plate. As mentioned previously, the enclosure framing may be suitably constructed using conventional fabrication techniques for steel-framed buildings and enclosures, including suitable welding of all contiguous portions of interconnected frame members. Suitable gussets, not shown, may be provided at the respective corners of the support bases 22 for connection to anchor bolts for anchoring the support bases and the enclosures constructed thereon to a support structure, such as the foundation or pad 23, for example. The tower sections 38 and 122 may be 0.50 inch thick cold rolled steel plate, and having a nominal diameter of about 4.50 feet. The tower sections 38 and 122 may have a cross section geometry other than cylindrical, including rectangular, hexagonal or octagonal, for example.

As mentioned previously, the sidewalls and roof decking of the enclosures 20 and 120 may be formed of 26-gauge metal corrugated paneling but could be constructed of reinforced concrete, fiberglass or other external surface panel material. The roof decks 137 are preferably formed of 0.38 or 0.50 inch thick steel plate. The interior wall 75 for the enclosure 20 may be constructed using conventional interior wall materials for industrial buildings. The flooring of the enclosures 20 and 120 may also be conventional, such as plywood with commercial vinyl tile laid thereover. Other fittings and materials used in constructing the enclosures 20 and 120 may be conventional with respect to techniques used to construct industrial weather-tight buildings and similar enclosures.

Figure 9:
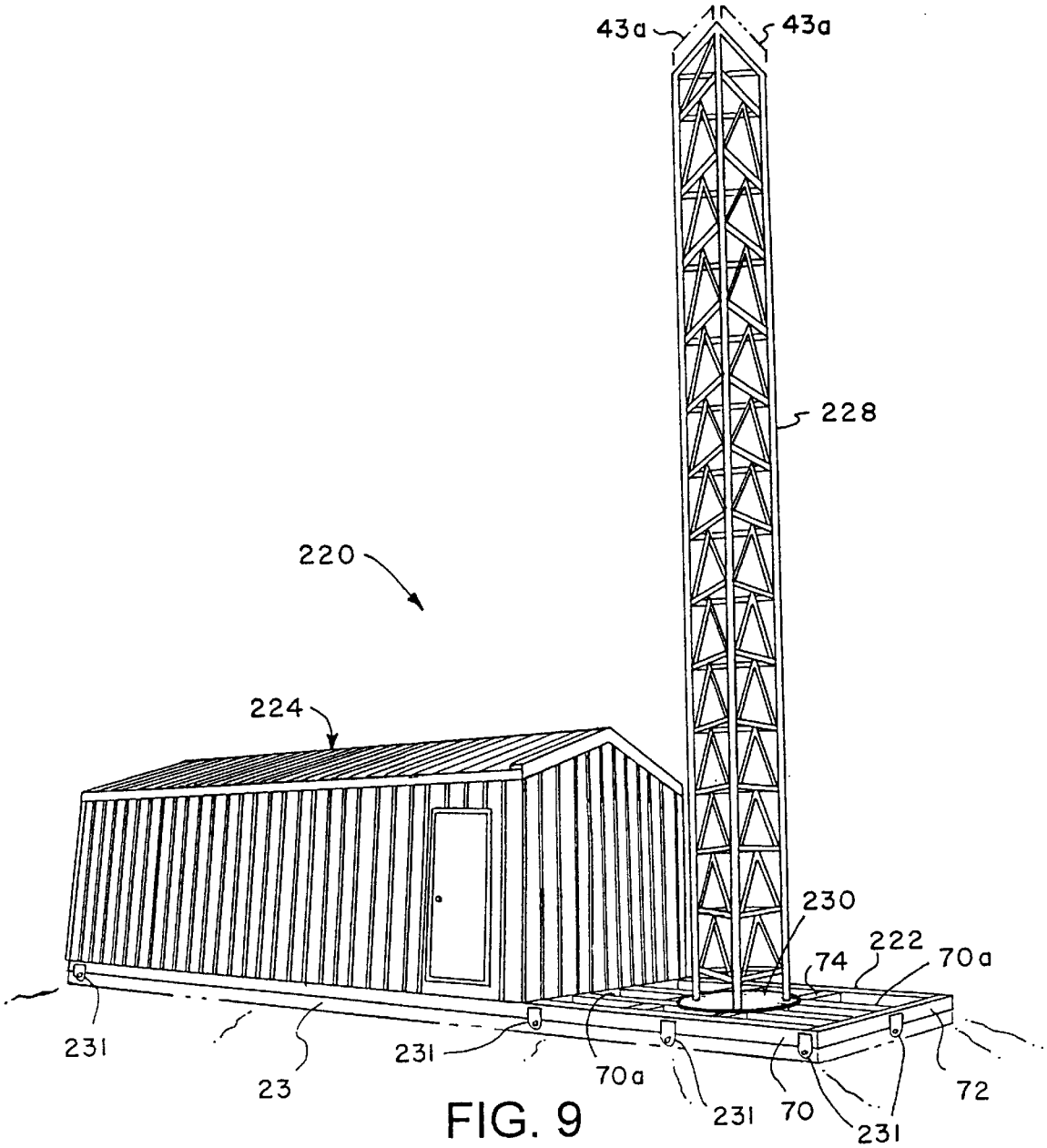
FIG. 9 is a perspective view of a second alternate embodiment of an enclosure and antenna support tower unit in accordance with the invention.

Referring now to FIG. 9, another embodiment of an integrated enclosure and support tower unit for communications antennas is illustrated and generally designated by the numeral 220. The integrated enclosure and support tower unit 220 includes a support base 222 which may be constructed substantially identical to the support base 22 and wherein the enclosure building itself, generally designated by the numeral 224, may be fabricated substantially like the enclosures 20 and 120 with the exception that the enclosure 224 has a shorter overall length and the cylindrical tower sections 38 and 122 have been eliminated. An antenna support tower 228 is mounted on the support base 222 at a base support plate 230. The support plate 230 may comprise a nominal 1.0-inch thick circular steel plate welded to the beams and joists of the support base 222, which beams and support joists are substantially those used in constructing the support base 22. Spaced apart depending tabs 231 are secured to the beams of the base 222 and are adapted to receive anchor bolts for anchoring the enclosure 220 to a foundation 23, as shown. The tower 228 may be constructed using conventional trusswork for communications towers and known to those skilled in the art.

The enclosure 220 enjoys the same benefits as the enclosures 20 and 120 with respect to prefabrication of the enclosure, including the support base 222, wherein the entire structure may be transported to an installation site ready to install the tower 228. Of course, depending on clearance requirements between the point of fabrication and the installation site, the integrated enclosure 220 may be shipped from the fabrication site to the installation site with the tower 228 or a portion thereof already installed.

The enclosure 224 may be, as previously mentioned, constructed substantially similar to the enclosures 20 and 120 with the exception that the support columns for the framing of the enclosure 224 may all be lighter in weight than those used in the framing of the enclosures 20 and 120. The materials used in other respects in constructing the enclosure 220 may be substantially similar to those described above for constructing the enclosures 20 and 120.

Figures 10, 11:
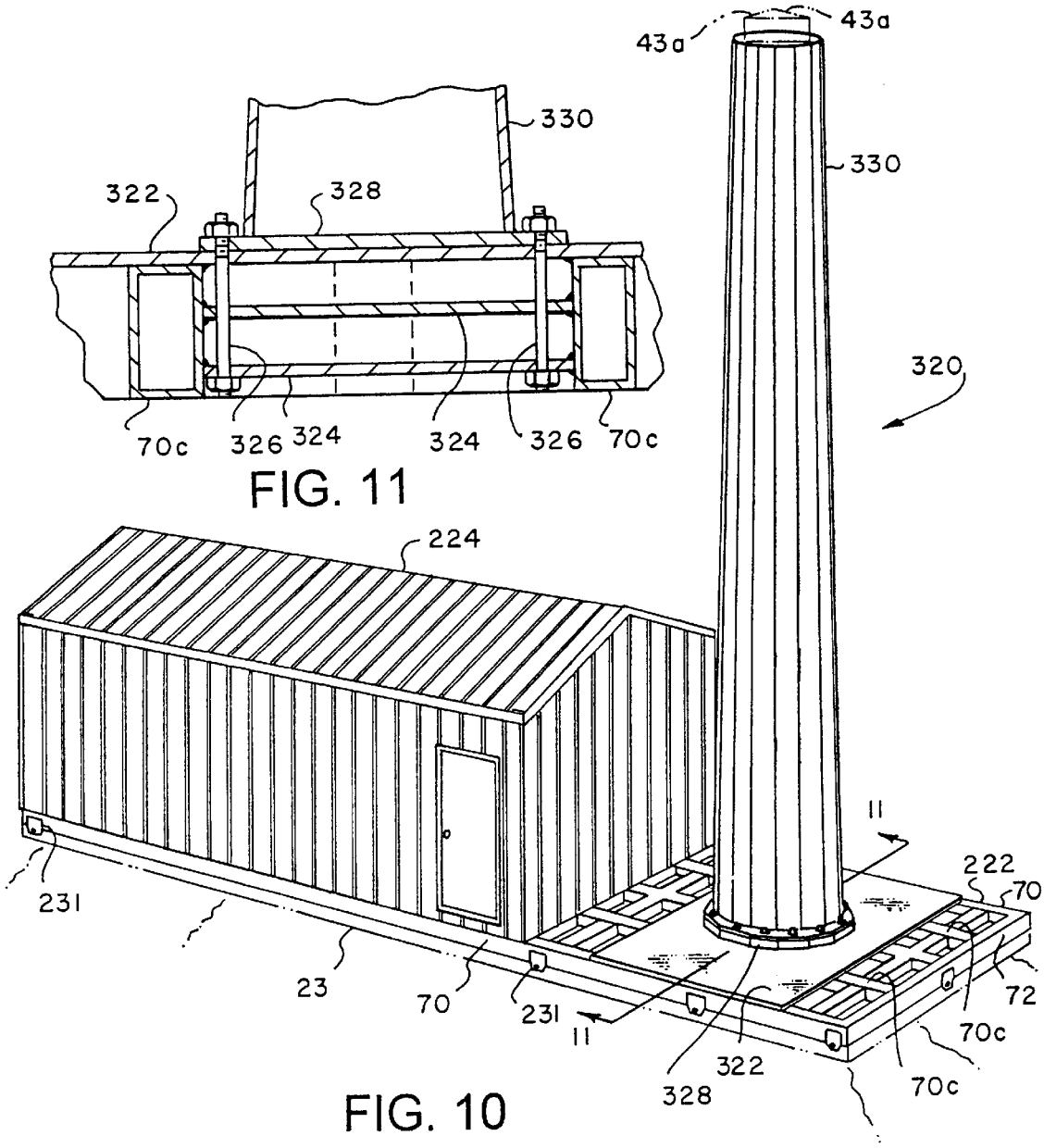
FIG. 10 is a perspective view of a third alternate embodiment of an enclosure and antenna support tower unit in accordance with the invention.
FIG. 11 is a detail section view taken from the line 11—11 of FIG. 10.

Referring now to FIGS. 10 and 11, an enclosure and antenna tower support unit in accordance with the invention is illustrated and generally designated by the numeral 320. The enclosure unit 320 includes an enclosure 224 supported on a support base 222 on which a generally rectangular reinforcing deck plate 322 is suitably secured, such as by welding. Support base 222 is modified slightly to include longitudinal intermediate beams 70*c*, see FIG. 11 also, which are of generally rectangular tubular cross sectional configuration. Spaced apart bolt stiffening and support plates 324 extend between the beams 70*c* and are suitably welded thereto and to form supports for elongated studs or bolts 326, FIG. 11, which are operable to be connected, as shown, to a generally cylindrical base member 328 of a tubular, polyhedral cross section, tapered monopole type tower 330 of a type known in the art for supporting floodlights, electrical transmission lines and other items requiring elevation above ground level. Suitable communications antenna 43*a* may, of course, be mounted on the tower 330 in the same manner as the antenna 43*a* are mounted on the tower 228, for example. Use of the tubular monopole type tower 330 may be preferred in certain applications of telephone and other wireless communications equipment in the interest of reduced costs and weight.

The construction and use of the enclosures 20, 120, 220 and 320 is believed to be within the purview of one of ordinary skill in the art of telecommunications equipment enclosures based on the foregoing description. Although preferred embodiments of the invention have been described in detail, those skilled in the art will also recognize that various substitutions and modifications may be made to the invention without departing from the scope and spirit of the appended claims.

What is claimed is:

1. An integrated enclosure and antenna support structure for a telecommunications transmitter or receiver installation comprising:

a support base characterized by spaced apart elongated beams and transverse joist members interconnecting said beams to form said support base;

an enclosure unit for enclosing telecommunications equipment;

support means for an antenna tower mounted on said support base adjacent to said enclosure, said support means comprising a deck plate mounted on and overlying at least plural ones of said beams and said joist members and a first support plate underlying said deck plate and between adjacent ones of said beams and said joist members and secured to said beams or said joist members;

an antenna support tower mounted on said deck plate and connected to said first support plate by plural bolt assemblies extending between said antenna support tower and said first support plate; and a second support plate intermediate said deck plate and said first support plate for stiffening said support base and said bolt assemblies.

2. An integrated enclosure and antenna support structure for a telecommunications transmitter or receiver installation comprising:

a support base characterized by spaced-apart elongated tubular beams and joist members interconnecting said beams to form said support base;

an enclosure unit mounted on said support base for enclosing telecommunications equipment;

a support member for an antenna tower on said support base adjacent to said enclosure, said support member being connected to one of said beams and said joists; and an antenna support tower mounted on said support member and connected to said support member.

3. The invention set forth in claim 2 wherein:

said support member comprises a deck plate supported on said support base.

4. The invention set forth in claim 3 wherein:

said support member further comprises at least two spaced apart support plates disposed between said beams and below said deck plate.

5. The invention set forth in claim 4 including:

a plurality of machine bolt and nut assemblies extending between said deck plate and one of said support plates for anchoring said antenna support tower to said support base.

6. The invention set forth in claim 2 wherein:

said beams are connected to spaced apart depending anchor tabs adapted to receive anchor bolts for anchoring said support base to a foundation for said structure.

7. The invention set forth in claim 2 wherein:

said antenna support tower comprises a tubular monopole.

8. The invention set forth in claim 2 wherein:

said antenna support tower comprises a truss type tower.

9. An integrated enclosure and antenna support structure for a telecommunications transmitter or receiver installation comprising:

a support base characterized by spaced-apart beams and elongated tubular joist members interconnecting said beams to form said support base;

an enclosure unit mounted on said support base for enclosing telecommunications equipment;

a support member for an antenna tower on said support base adjacent to said enclosure, said support member being connected to one of said beams and said joists; and an antenna support tower mounted on said support member and connected to said support member.

* * * * *